US008240097B2

(12) United States Patent
Day et al.

(10) Patent No.: US 8,240,097 B2
(45) Date of Patent: Aug. 14, 2012

(54) WOOD POST ANCHORING BASE

(75) Inventors: Randall Lee Day, Lamar, MO (US); Daniel Ray Whyman, Lamar, MO (US)

(73) Assignee: Backyard Leisure Holdings, Inc., Pittsburg, KS (US)

( * ) Notice: Subject to any disclaimer, the term of this patent is extended or adjusted under 35 U.S.C. 154(b) by 69 days.

(21) Appl. No.: 12/717,467

(22) Filed: Mar. 4, 2010

(65) Prior Publication Data

US 2011/0214363 A1 Sep. 8, 2011

(51) Int. Cl.
*E02D 27/42* (2006.01)
*A47B 91/00* (2006.01)

(52) U.S. Cl. ..... 52/298; 52/296; 52/297; 248/346.5

(58) Field of Classification Search ..... 52/169.5, 52/169.9, 169.13, 155, 165, 296–298, 169.2, 52/DIG. 11, 302.1, 302.5, 765; 248/346.01, 248/346.03, 346.5, 188.1, 231.31, 523, 519, 248/529, 539, 903, 910
See application file for complete search history.

(56) References Cited

U.S. PATENT DOCUMENTS 5,568,909 A * 10/1996 Timko ..... 248/519
6,336,620 B1 * 1/2002 Belli ..... 248/519
6,729,089 B1 * 5/2004 Spragg ..... 52/296
6,948,283 B2 * 9/2005 Burkart et al. ..... 52/155
7,610,733 B2 * 11/2009 Rizzotto ..... 52/745.21
2004/0025460 A1 * 2/2004 Terrels ..... 52/298
2007/0187564 A1 * 8/2007 McGuire ..... 248/346.5
2007/0209316 A1 * 9/2007 Walker ..... 52/736.1
2007/0235616 A1 * 10/2007 Gross et al. ..... 248/346.5

* cited by examiner

*Primary Examiner* — Basil Katcheves
*Assistant Examiner* — Beth Stephan
(74) *Attorney, Agent, or Firm* — Hovey Williams LLP

(57) ABSTRACT

A post anchoring foot is configured for use in securing a post to a surface. The foot includes a body dimensioned to snugly receive a portion of the post, with the body including a generally horizontal base portion and a generally vertical side wall that cooperatively present a laterally enclosed post-receiving area. The base portion defines a lowermost surface-engaging anchoring face and an elevated supporting face configured to engage an end of the post, with the supporting face being disposed above the anchoring face. The base portion further defines a plurality of anchor-receiving apertures extending therethrough, with each aperture being configured to receive an anchor therein to securely couple the foot to the surface. The side wall defines a fastener-receiving hole extending therethrough, with the hole being configured to selectively receive a fastener therein to securely couple the foot to the post.

16 Claims, 5 Drawing Sheets

WOOD POST ANCHORING BASE

BACKGROUND OF THE INVENTION

1. Field of the Invention

The present invention relates generally to a post anchoring foot for securing a post to a surface. More specifically, the present invention concerns a post anchoring foot that includes a body that is dimensioned to snugly receive a portion of the post within a substantially laterally enclosed post-receiving area, with the body defining anchor-receiving apertures to securely couple the foot to the surface and a fastener-receiving hole to securely couple the foot to the post.

2. Discussion of the Prior Art

Those of ordinary skill in the art will appreciate that many outdoor structures, such as decking, gazebos, pavilions, pergolas, and the like, typically include upright posts that need to be disposed on a base surface. In some instances, these upright posts may simply be placed upon the base surface, such that the weight of the post itself, or the post coupled with additional structural members, sufficiently maintains the post in place. Depending on the complexity and construction of the structure connected to the post, however, the upright posts may have to support substantial weight or sustain sufficient external forces, such that securing the post to the base surface is desired.

Conventionally, such upright posts have been secured to a ground surface by simply driving the post into the ground or by digging a hole to set the post in concrete. If the post is to be secured to a more finished surface, such as decking or a concrete pad, then the post has traditionally been secured directly to the surface. For example, posts have been secured to decking by simply screwing the post directly to the decking. In another example, posts have been secured to concrete pads with the use of an angle iron brace fastened to both a side of the post and to the surface. In both such instances, the post directly engages the surface to which it is secured.

Directly engaging attachment between the post and the surface has been satisfactory in some respects, but has also presented drawbacks. Because the post directly engages the surface, water or other liquid that may remain on the surface can easily come into contact with the post for prolonged periods of time, even wicking into the bottom portion of the post that contacts the surface. Such exposure to water or other liquids can cause premature rotting of wood posts, leading to unsightly damage and requiring repair or replacement. Moreover, an angle iron brace provides dedicated support only to the side of the post to which it is secured. Thus, multiple braces are required to support the post from external forces in multiple directions. Angle iron braces are also prone to rust in an outdoor environment, leading to an unsightly appearance or requiring that the connecting brace be covered with separate decorative trim.

SUMMARY

According to an aspect of the present invention, a post anchoring foot is configured to facilitate a secure connection of a post to a surface. The foot includes a body dimensioned to snugly receive a portion of the post, with the body including a base portion and a side wall that cooperatively present a laterally enclosed post-receiving area. This inventive construction provides a sturdy connection between the post, the foot, and the surface that is able to withstand external forces emanating from multiple directions, while also creating an aesthetically pleasing connection between the post, the foot, and the surface. The base portion defines a lowermost surface-engaging face and an elevated supporting face configured to engage an end of the post, with the supporting face being disposed above said anchoring face. This unique construction elevates the end of the post away from direct contact with the surface and can prevent prolonged contact with water, reducing the risk of premature wood rot. The body defines anchor-receiving apertures to securely couple the foot to the surface and a fastener-receiving hole to securely couple the foot to the post.

According to one aspect of the present invention, a post anchoring foot is provided for use in securing a post to a surface. The foot includes a body dimensioned to snugly receive a portion of the post. The body includes a generally horizontally extending base portion and a generally upstanding side wall configured to circumscribe the received portion of the post. The base portion and the side wall cooperatively present a substantially laterally enclosed post-receiving area. The base portion defines a lowermost surface-engaging anchoring face. The base portion also defines an elevated supporting face that is configured to engage an end of the received portion of the post. The supporting face is disposed above the anchoring face. The base portion further defines a plurality of anchor-receiving apertures that extend therethrough. Each aperture is configured to selectively receive an anchor therein to securely couple the foot to the surface. The side wall presents a laterally inner post-engaging face and an opposite laterally outer face. The side wall defines a fastener-receiving hole that extends therethrough between the inner and outer faces, with the hole being disposed above the supporting face. The hole is configured to selectively receive a fastener therein to securely couple the foot to the post.

This summary is provided to introduce a selection of concepts in a simplified form that are further described below in the detailed description of the preferred embodiments. This summary is not intended to identify key features or essential features of the claimed subject matter, nor is it intended to be used to limit the scope of the claimed subject matter.

Various other aspects and advantages of the present invention will be apparent from the following detailed description of the preferred embodiments and the accompanying drawing figures.

BRIEF DESCRIPTION OF THE DRAWING FIGURES

A preferred embodiment of the present invention is described in detail below with reference to the attached drawing figures, wherein.

Figure 1:
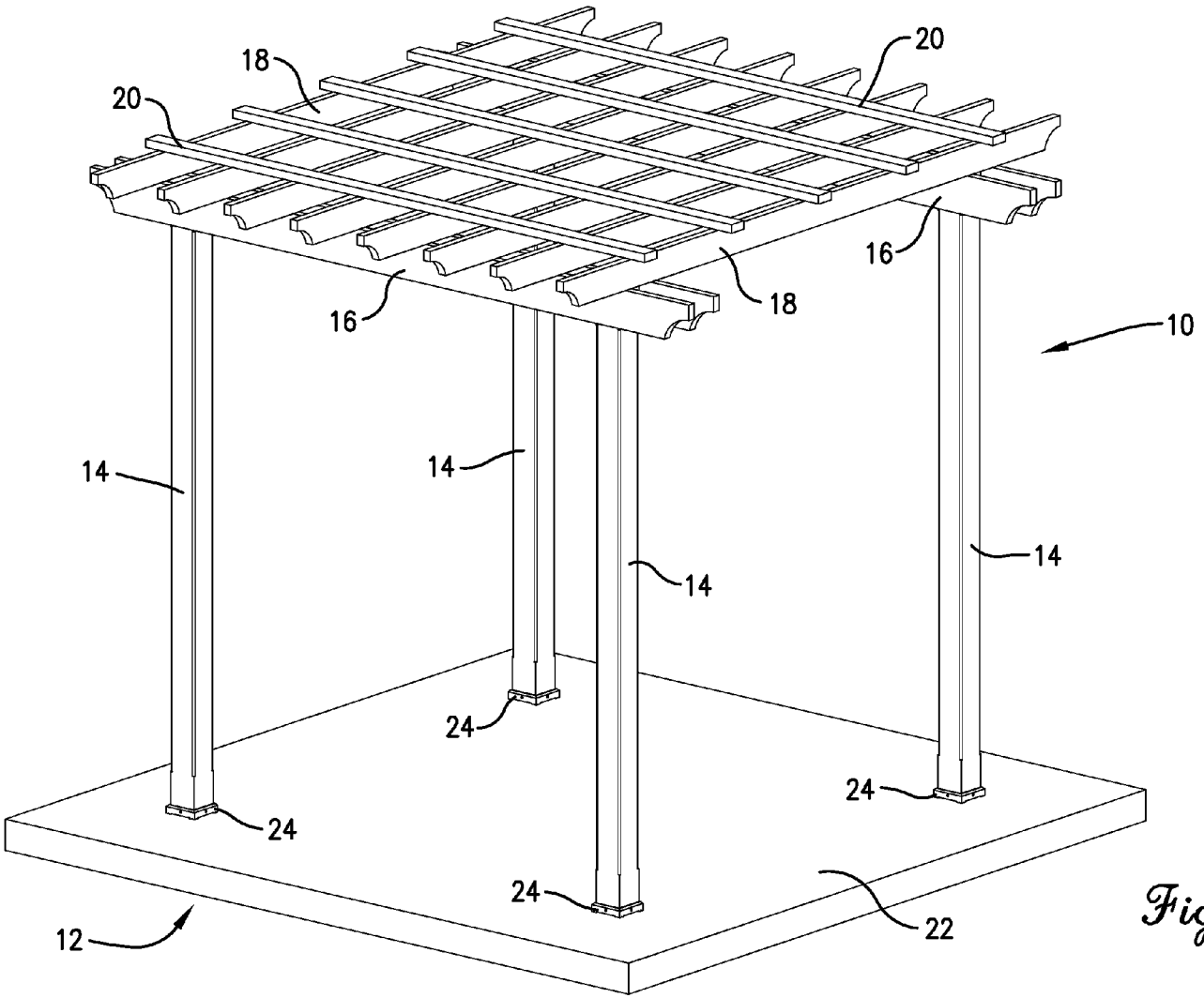
FIG. 1 is an isometric view of a pergola structure including a plurality of upright posts, with a lower portion of each post being received within a post anchoring foot constructed in accordance with the principles of a preferred embodiment of the present invention, and thereby secured to a surface of a concrete pad.
Figure 4:
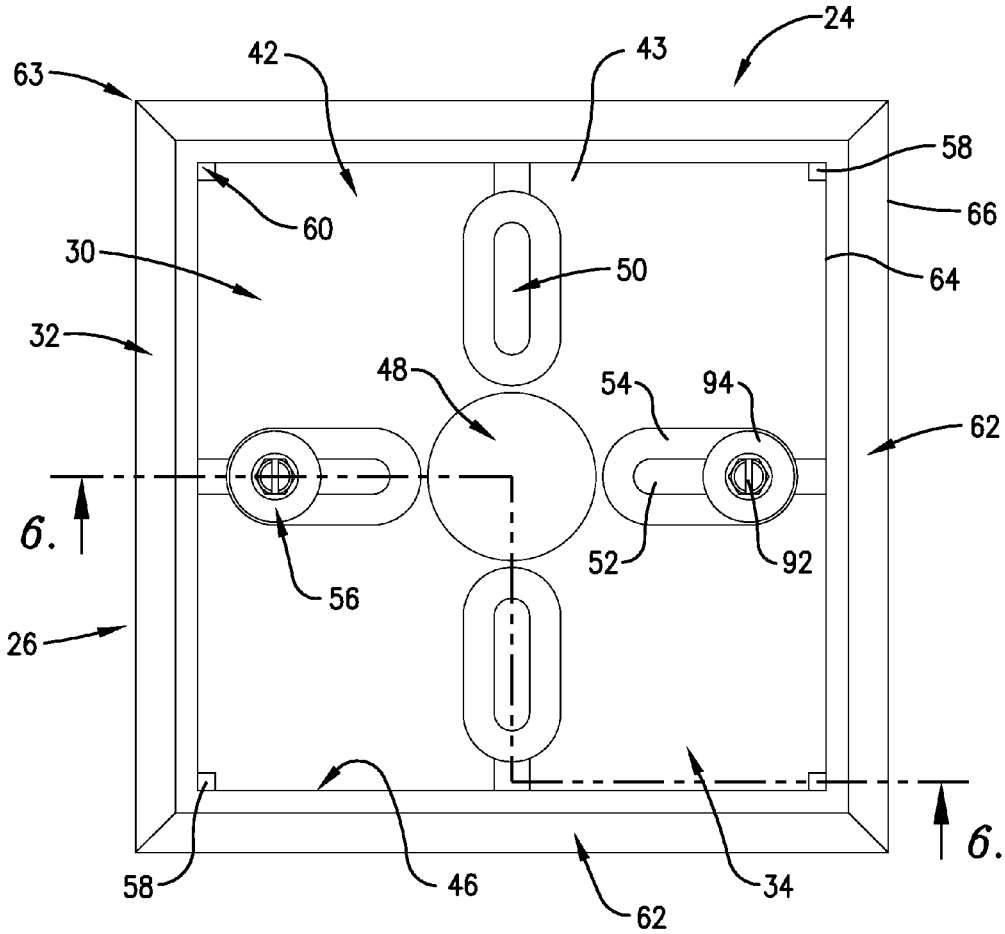
FIG. 4 is an enlarged, top-down plan view of one post anchoring foot of FIG. 1, illustrated with a plurality of anchors received in selected ones of a plurality of anchor-receiving apertures extending through a base portion of the foot.
Figure 6:
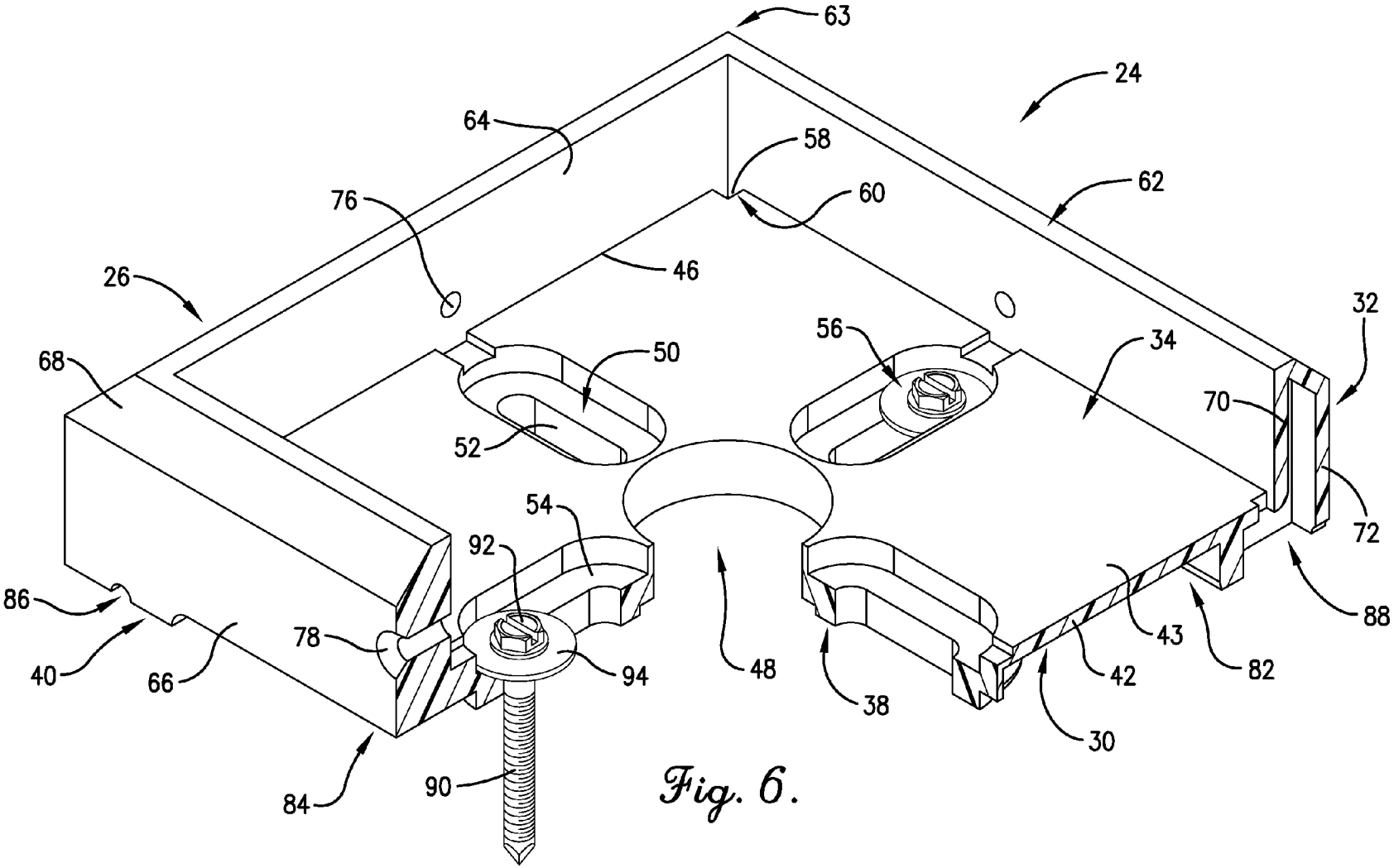
Figure 7:
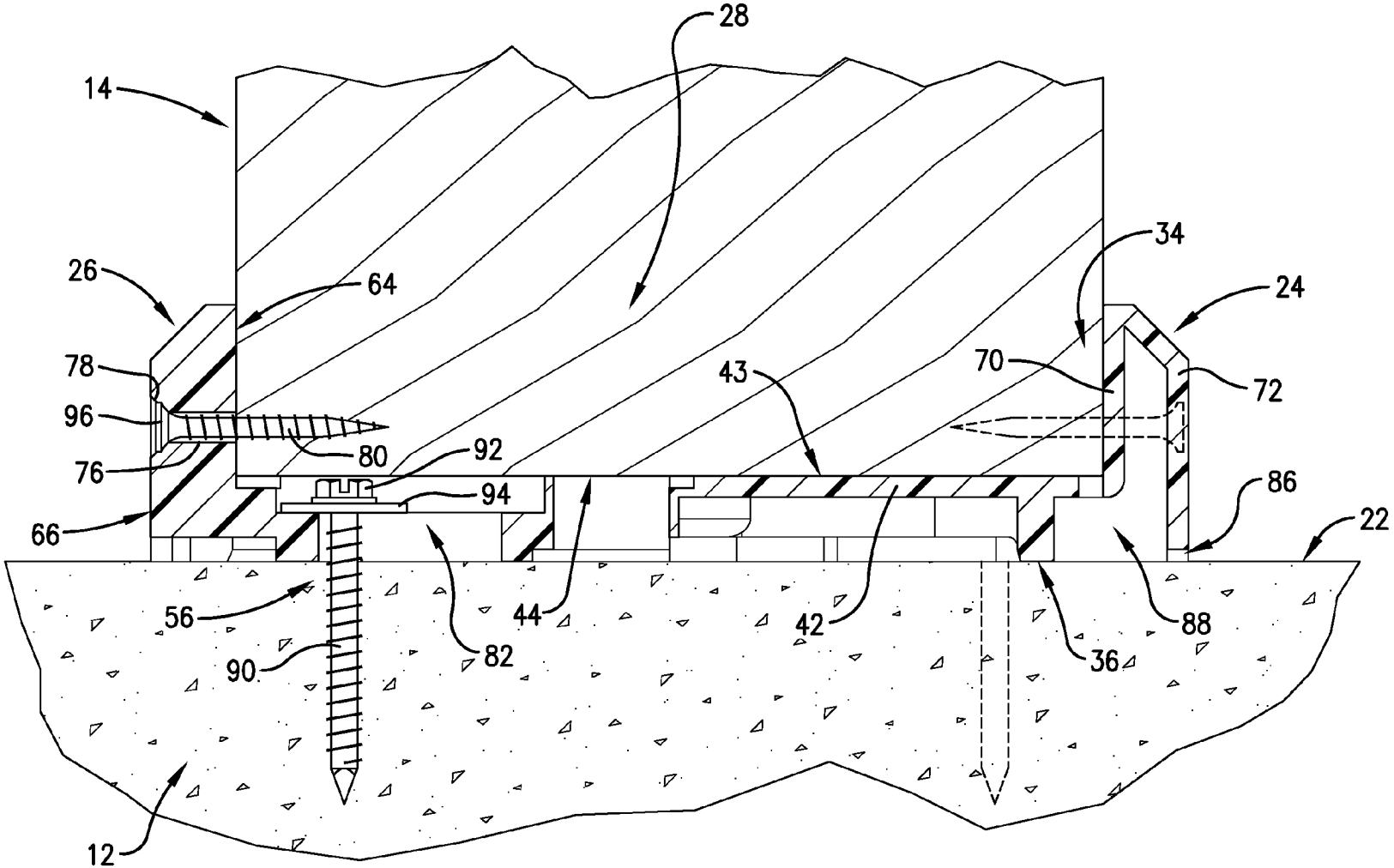

FIG. 6 is an enlarged, isometric, cutaway sectional view of one post anchoring foot of FIG. 1, taken along the line 6-6 of FIG. 4, depicting in detail anchors received in selected ones of the plurality of anchor-receiving apertures extending through a base portion of the foot, as well as details of construction of the base portion and the side wall; and FIG. 7 is an enlarged, side elevation, sectional view of one post anchoring foot of FIG. 1, illustrated with a portion of a post being received therein to secure the post to a concrete pad, with a screw fastener projecting through the hole in the side wall to couple the foot to the post, and with an anchor projecting through one of the plurality of apertures to couple the foot to the concrete pad.

The drawing figures do not limit the present invention to the specific embodiments disclosed and described herein. The drawings are not necessarily to scale, emphasis instead being placed upon clearly illustrating the principles of the preferred embodiments.

DETAILED DESCRIPTION OF THE PREFERRED EMBODIMENTS

The present invention is susceptible of embodiment in many different forms. While the drawings illustrate, and the specification describes, certain preferred embodiments of the invention, it is to be understood that such disclosure is by way of example only. There is no intent to limit the principles of the present invention to the particular disclosed embodiments.

With initial reference to FIG. 1, a pergola structure 10 selected for purposes of illustration is secured to a concrete pad 12. The pergola structure 10 broadly includes four identical upright posts 14, which serve to elevate lower cross beams 16, alternating intermediate cross beams 18, and alternating upper cross beams 20 above the concrete pad 12 (with the upper cross beams 20 extending substantially in the same direction as the lower cross beams 16), as is generally known in the art.

The elevated cross beams 16, 18, 20 are secured together in a conventional manner (such as by adhesive, screws or other fasteners, or combinations thereof). It is noted that the depicted pergola structure 10 is shown by way of example only, with it being readily understood that the specific nature of the pergola structure 10 is not intended to be limiting on the present invention in any way. The pergola structure 10 includes the upright posts 14 that elevate the cross beams 16, 18, 20. In the illustrated embodiment, each of the posts 14 is a conventional six-inch by six-inch (6"×6") wooden post, although other suitable shapes (e.g., round, rectangular, triangular, or the like), sizes (e.g., four-inch by four-inch (4"× 4")), and/or materials (e.g., composite wood material, vinyl, aluminum, or the like) can be used for alternative posts (not shown) without departing from the teachings of the present invention.

The concrete pad 12 is generally conventional in nature and presents a top surface 22. The surface 22 to which the posts 14 are secured need not be concrete, but could alternatively be, for example, wooden or composite decking, a patio formation, etc., as will be readily appreciated by one of ordinary skill in the art upon review of this disclosure.

Each post 14 is secured to the top surface 22 of the concrete pad 12 with a post anchoring foot 24 constructed in accordance with a preferred embodiment of the present invention. The four post anchoring feet 24 depicted in FIG. 1 are identical (and correspond with the matching posts 14, as explained below). It is noted that, for clarity and convenience, only one post anchoring foot 24 from the environmental view of FIG. 1 is illustrated in detail in FIGS. 2-7 and described hereinbelow. As described above, each post anchoring foot 24 is shown securing one wooden post 14 to the top surface 22 of the concrete pad 12. However, the post anchoring foot 24, or an alternatively configured post anchoring foot (not shown) can also be used with other types and/or shapes of posts (not shown) and to secure such posts to different types of surfaces (not shown), as described above, without departing from the teachings of the present invention.

While the post anchoring foot 24 may be used with a variety of post materials and types as noted above, it is emphasized that the post anchoring foot 24 described herein is particularly useful in anchoring and supporting a wooden post, which may be more susceptible to rot and/or possible structural concerns relative to the other possible post designs. This particular suitability, while not intended to be limiting on the present invention, is believed to be achieved in part by maintaining the post 14 in a disposition above the top surface 22 of the concrete pad 12 (away from liquids that may collect on the surface 22), and by facilitating drainage of any fluids that do contact the post 14 away from the post 14 and post anchoring foot 24, as explained in detail below.

Figure 2:
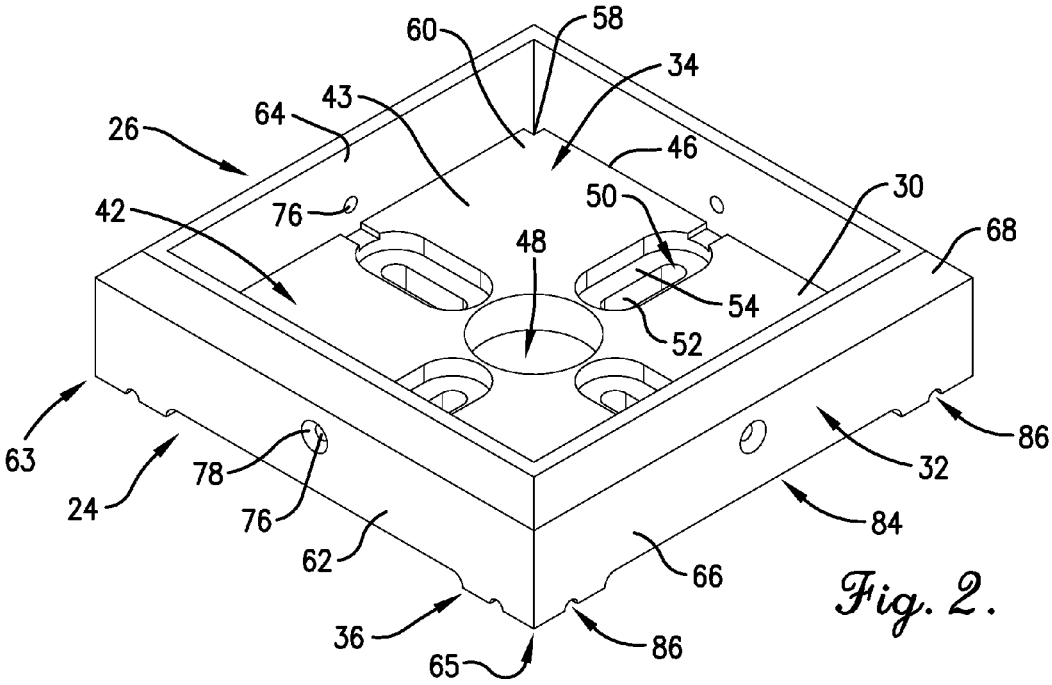
FIG. 2 is an enlarged, generally right-side-up, isometric view of one post anchoring foot of FIG. 1, illustrated without a post being received therein and particularly depicting details of an interior post-receiving area.
Figure 3:
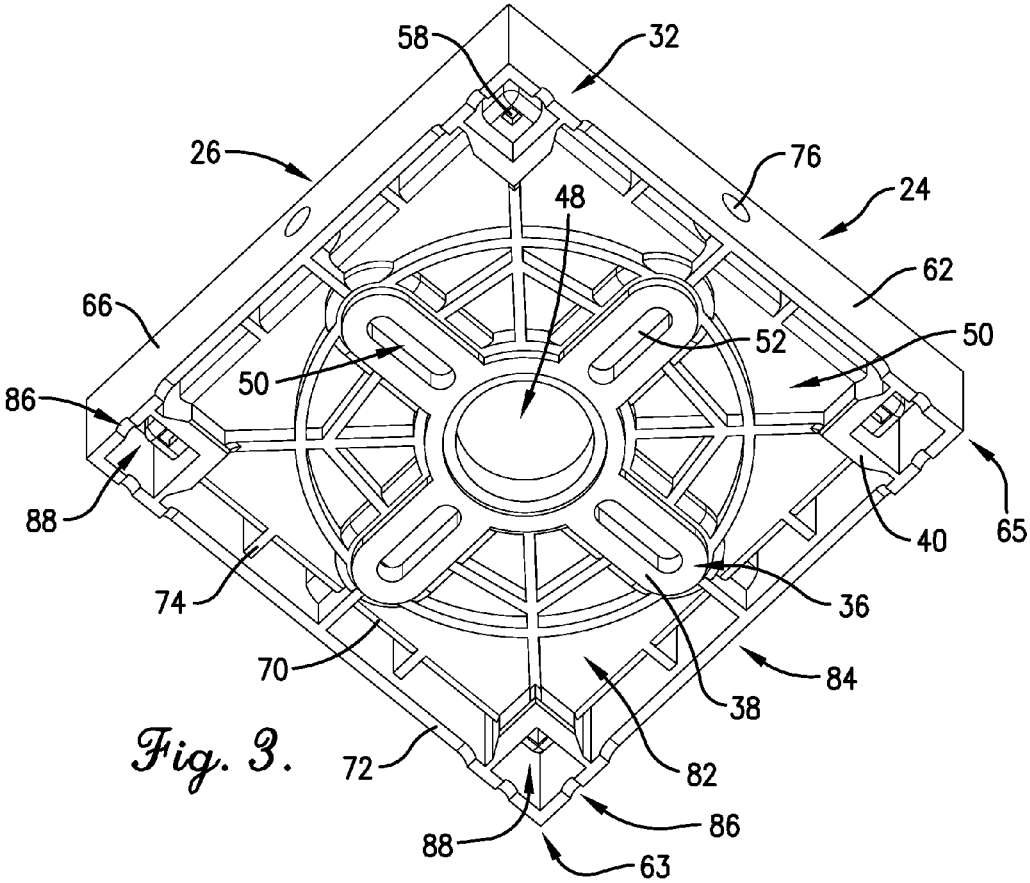
FIG. 3 is an enlarged, generally upside-down, isometric view of one post anchoring foot of FIG. 1, particularly depicting details of a lowermost surface-engaging anchoring face.

Turning now to FIGS. 2 and 3, and with brief reference to FIG. 7, the post anchoring foot 24 comprises a body 26 that is dimensioned to snugly receive a portion 28 of the post 14 (as shown in FIG. 7). The body 26 broadly includes a generally horizontally extending base portion 30 and a generally upstanding side wall 32. As shown in detail in FIG. 7, The side wall 32 is configured to circumscribe the received portion 28 of the post 14. As shown particularly in FIG. 2, the base portion 30 and the side wall 32 cooperatively present a substantially laterally enclosed post-receiving area 34.

With continued reference to the overview of the post anchoring foot 24 as depicted in FIGS. 2 and 3, it is noted that the post anchoring foot 24 is preferably formed of a synthetic resin material, such as high-density polyethylene. Furthermore, the body 26 of the illustrated post anchoring foot 24 consists essentially of a unitarily-formed element, such as a molded element. Applicant notes that the term "unitarily-formed" as used herein is interchangeable with the term "integrally-formed" as such terms are generally understood in the art, and means that elements and/or portions of such a unitarily formed body are "integral" and are not attached to each other in a separate step or detachable from each other, but are formed from a single piece of material. In the exemplary embodiment depicted, for example the body 26 is formed as a single piece of suitable material, such as by injection molding.

Figure 5:
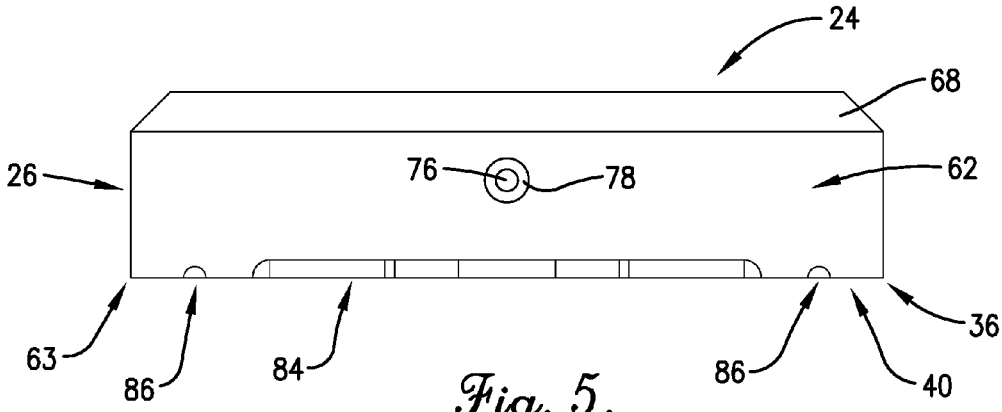
FIG. 5 is an enlarged, side elevation view of one post anchoring foot of FIG. 1, particularly depicting details of an outer face of a side wall of the foot, including a fastener-receiving hole extending therethrough and a drain opening extending upwardly from the anchoring face.

With reference now to FIGS. 3, 5, and 7, the base portion 30 defines a lowermost surface-engaging anchoring face 36. As shown in the illustrated embodiment, particularly in FIGS. 5 and 7, the surface-engaging anchoring face 36 is generally planar and is configured to flushly engage the top surface 22 of the concrete pad 12. With specific reference to FIG. 3, it is noted that the surface-engaging anchoring face 36 comprises a central stand element 38 and a plurality of outer stand elements 40. In the illustrated embodiment, a plurality of four outer stand elements 40 are discreetly spaced about the laterally outer periphery of the base portion 30, although other configurations, including a single, continuous stand element (not shown) remain within the ambit of the present invention. As can be seen particularly in FIGS. 5 and 7, the central stand element 38 and the plurality of outer stand elements 40 cooperatively form the generally planar surface engaging anchoring face 36.

With attention now to FIGS. 2, 4, and 7, the base portion 30 also defines an elevated supporting face 42 that is configured to engage an end 44 of the received portion 28 of the post 14. As depicted particularly in FIG. 7, the elevated supporting face 42 is disposed above the surface-engaging anchoring face 36, such that the post 14, when received within the post anchoring foot 24, is raised above the top surface 22 of the concrete pad 12. As shown in the illustrated embodiment, particularly in FIGS. 2, 4, and 6, the elevated supporting face 42 forms a generally planar bottom floor 43 and is configured to flushly engage the end 44 of the received portion 28 of the post 14. It is noted, however, that an alternative supporting face (not shown) may take non-planar forms without departing from the teachings of the present invention. Moreover, in the illustrated embodiment, the bottom floor 43 and the upstanding side wall 32 are substantially orthogonal to one another, although such relationship is not required and may not be included in an alternative post anchoring foot (not shown) configured for use with a differently-shaped post (not shown).

With continued attention to FIGS. 2, 4, and 6, the elevated supporting face 42 presents a laterally outer periphery 46 that is substantially square shaped in the depicted embodiment, although alternatively shaped outer peripheries (not shown) may be configured as necessary to correspond to the shape of a post to be received within the body 26, as will be readily appreciated by one of ordinary skill in the art upon review of this disclosure. The elevated supporting face 42 intersects a generally centrally-disposed hole 48 that extends through, and is defined by, the base portion 30 of the body 26. The elevated supporting face 42 further intersects a plurality of anchor-receiving apertures 50 that are disposed radially about the central hole 48 and that extend through, and are defined by, the base portion 30 of the body 26. Each anchor-receiving aperture 50 comprises a laterally extending slot 52 and a washer-engaging surface 54 that is disposed below the elevated supporting face 42.

In the illustrated embodiment, the elevated supporting face 42 defines four anchor-receiving apertures 50 that are generally radially uniformly distributed about the central hole 48, although more or fewer of such apertures 50 may be alternatively defined. Each anchor-receiving apertures 50 is configured to receive an anchor assembly 56 therethrough, as depicted in FIGS. 4, 6, and 7, and described below. As will be readily appreciated by one of ordinary skill in the art, the laterally extending slot 52 of each anchor-receiving aperture 50 provides some adjustability when securing the body 26 of the post anchoring foot 24 to the concrete pad 12. Finally, the elevated supporting face 42 intersects a plurality of drain holes 58 that extend through, and are defined by, the base portion 30 of the body 26. Each of the drain holes 58 is preferably, though not necessarily, disposed adjacent a corner 60 of the laterally outer periphery 46 of the elevated supporting face 42.

Turning now to FIGS. 2, 5, 6, and 7, the upstanding side wall 32 of the illustrated embodiment includes a plurality of side wall portions 62, with each side wall portion 62 corresponding to a side of the portion 28 of the post 14 to be received in the post-receiving area 34 of the post anchoring foot 24. In particular, four side wall portions 62 cooperatively form the side wall 32 of the depicted embodiment, with adjacent pairs of side wall portions 62 intersecting to form corners 63. More specifically, because the side wall portions 62 of the illustrated embodiment correspond to the sides of the portion 28 of the square post 14, adjacent pairs of the side wall portions 62 intersect one another at right angles such that the corners 63 are generally square.

Because each of the four side wall portions 62 of the illustrated embodiment are identical, it is noted that, for clarity and convenience, a detailed description of only one side wall portion 62 is provided below, with it being readily understood that such description and details of construction of one side wall portion 62 applies equally to each of the depicted side wall portions 62 of the illustrated embodiment.

It is further noted that, although four identical side wall portions 62 are illustrated herein (thus forming a square-shaped post-receiving area 34 that corresponds to the square post 14 received therein), alternative side wall portions (not shown) could take other forms and/or numbers without departing from the teachings of the present invention. For example, an alternative side wall (not shown) could be formed of a plurality of dissimilarly shaped or dimensioned side wall portions (such as to accommodate a rectangular-shaped post), or a different number of side wall portions (such as to accommodate a different polygonal-shaped post). In this way, through correspondence between the shape of a post to be received by the post anchoring foot and the shape of a post-receiving area defined by the side wall, the post is snugly received therein, as will be readily appreciated by one of ordinary skill in the art upon review of this disclosure. Moreover, an alternative side wall could be formed of a single side wall portion (such as a circular side wall portion shaped to accommodate a round post), with all of such alternative configurations remaining within the ambit of the present invention.

Each side wall portion 62 of the illustrated embodiment presents a laterally inner post-engaging face 64 and an opposite laterally outer face 66. As can be seen particularly in FIGS. 2 and 6, the outer face 66 includes a chamfer portion 68, although the inclusion of other such surface features, such as a woodgrain pattern or other aesthetic markings (not shown) may be incorporated without departing from the teachings of the present invention. With particular reference to FIGS. 6 and 7, each side wall portion 62 comprises an inner section 70 and an outer section 72. As shown perhaps most clearly in FIG. 3, portions of each inner section 70 and outer section 72 are connected by generally laterally extending, radially spanning ribs 74.

As depicted particularly in FIG. 4, it can be seen that the laterally outer periphery shape defined by the plurality of illustrated side wall portions 62 is the same as the shape of the outer periphery of the elevated supporting face 42. More specifically, as depicted herein, both the lateral shape defined by the plurality of illustrated side wall portions 62 and the shape of the outer periphery of the elevated supporting face 42 are square-shaped (to accommodate a square-shaped post 14, as described above). Even more specifically, the inner post-engaging face 64 of each side wall portion 62 presents a horizontal dimension that measures approximately five and one half inches (5.5"), such that the resultant post-receiving area 34 is configured to receive a commercially available six-inch by six-inch (6"×6") post.

In the illustrated embodiment, each side wall portion 62 defines a fastener-receiving hole 76 extending therethrough between the inner post-engaging face 64 and the opposite outer face 66. As shown in FIGS. 2 and 6, each hole 76 is disposed above the elevated supporting face 42. Each fastener-receiving hole 76 is associated with a countersink 78 being defined by the side wall portion 62 and extending inwardly from the outer face 66, such that each fastener-receiving hole 76 is configured to receive a fastener 80 therethrough, as depicted in FIGS. 6 and 7, and described below.

With reference now to FIGS. 2, 3, 6, and 7, the body 26 includes a liquid draining area 82 that is generally defined between the lowermost anchoring face 36 and the elevated supporting face 42. The outer face 66 of each side wall portion 62 defines a plurality of drain openings 84, 86 therein that each extend upwardly from the lowermost anchoring face 36, such that the liquid draining area 82 is in fluid communication with the environment outside of the body 26 of the anchoring foot 24 via the drain openings 84, 86. In the illustrated embodiment, the drain opening 84 is generally laterally elongated and stretches along a majority of the length of the outer face 66 of the side wall portion 62. Also in the illustrated embodiment, the drain openings 86 are each generally semicircular in shape, with one drain opening 86 being disposed generally outboard of each end of the central drain opening 84 along the outer face 66 of the side wall portion 62.

As will be readily appreciated by one of ordinary skill in the art, liquid (such as rain water or another fluid to which the outdoor pergola structure 10, the concrete pad 12, or both, may be exposed) may enter the liquid draining area 82 in a number of ways. For example, standing water that may collect around the anchoring foot 24 may run into the liquid draining area 82 through any of the drain openings 84, 86; however, the water can also flow out of the liquid draining area 82 and away from the body 26 of the anchoring foot 24 through the same or different drain openings 84, 86. In another example, rain water or over spray from a hose or the like may contact the post 14 and run down the same toward the body 26 of the anchoring foot 24. In such a situation, the water may drain through any of the drain holes 58, or even the central hole 48, into the liquid draining area 82 (so as not to undesirably collect on the elevated supporting face 42 or remain around the post 44 for an extended period of time). In this situation, it is particularly noted that water or other liquid that may even temporarily remain within the liquid draining area 82 (which rests on the top surface 22 of the concrete pad 12) is maintained below and away from the post and 44 (which rests on top of the elevated supporting face 42).

With specific reference now to FIG. 3, each of the outer stand elements 40 defines a substantially hollow space 88, illustrated as a generally square-shaped recess disposed approximately adjacent each corner 63 of the body 26 of the anchoring foot 24. In more detail, each drain hole 58 extending through the elevated supporting face 40 is in fluid communication with a respective one of the hollow spaces 88. Moreover, a pair of the drain openings 86 (one from each side wall portion 62) is disposed to provide fluid communication between the hollow space 88 and the environment. In such illustrated configuration, any the water or other fluid that might contact the elevated supporting face 42 may flow away therefrom through drain hole 58, into hollow space 88, through one of the drain openings 86, and out and the environment.

The operation of the post anchoring foot 24 should be apparent from the foregoing and, therefore, will be described here only briefly. Initially, it is noted that the post anchoring foot 24 should be selected to correspond with the size and shape of the post 14 to be anchored to the surface 22 thereby. In addition, appropriate anchor assemblies 56 should be selected based upon the substrate to which the post anchoring foot 24 will be secured. As described above, in the illustrated embodiment, wooden posts 14 are to be secured to the top surface 22 of concrete pad 12.

As a first step, the post anchoring foot 24 will be secured to the top surface 22 of the concrete pad 12. Upon determining the appropriate location in which to secure the post anchoring foot 24, each anchor assembly 56 is passed down through the anchor-receiving aperture 50 in the elevated supporting face 42 and into the concrete pad 12. In more detail, a generally conventional concrete anchor 90 including a head 92 is passed first through a traditional washer 94, through the slot 62, and into the concrete pad 12. With reference to FIGS. 6 and 7, the concrete anchor 90 is secured to the concrete pad 12 in a conventional manner (such as by twisting) in order to flushly and securely seat the lowermost anchoring face 36 of the body 26 of the anchoring foot 24 against the top surface 22 of the concrete pad 12. Additional anchor assemblies 56 may be secured in like manner.

As discussed above, the shape of the slots 62 permits some adjustability of the positioning of the anchoring foot 24 prior to final tightening of the anchor assemblies 56. With continued reference to FIGS. 6 and 7, it can be seen that when each anchor assembly 56 is in the final securing disposition, the washer 94 contacts and provides a downward force against the washer-engaging surface 54 to securely maintain the anchoring foot 24 in place. Furthermore, the head 92 of the anchor 90 contacts and provides a downward force against the washer 94, with the head 92 being disposed underneath the elevated supporting face 42 of the body 26 of the anchoring foot 24. In this way, no part of the anchor assembly 56 extends above the elevated supporting face 42, such that engagement of the portion 28 of the post 14 received within the post-receiving area 34 against the elevated supporting face 42 is unobstructed.

Next, the post 14 is secured to the anchoring foot 24. In more detail, the portion 28 of the post 14 to be snugly received within the post-receiving area 34 is inserted therein such that appropriate portions of the post 14 engage the elevated supporting face 42 of the base portions 30 and the inner post-engaging face 64 of the upstanding side wall 32. After the post 14 is in position within the post-receiving area 34 of the body 26 of the anchoring foot 24, a fastener 80 in the form of a screw, including a screw head 96, is passed through the hole 76 and into the portion 28 of the post 14.

With continued reference to FIGS. 6 and 7, the fastener 80 is secured to the post 14 and a conventional manner (such as by twisting) in order to securely couple the post 14 to the anchoring foot 24. Additional fasteners 80 may be secured in like manner. Preferably, a fastener 80 is attached to each side of the post 14 to provide the greatest degree of support. As shown in FIG. 7, it can be seen that when each fastener 80 is in the final securing disposition, the screw head 96 is disposed within the countersink 78. In this way, no part of the fastener 88 extends laterally beyond the outer face 66 of the wall portion 62, to provide a clean appearance to the outside of the anchoring foot 24 and reduce possible safety hazards.

As will be readily understood by one of ordinary skill in the art upon review of this disclosure, the anchoring foot 24 described above serves to securely anchor the post 14 to the concrete pad 12. Moreover, the unitarily-formed body 26 of the anchoring foot 24 laterally surrounds and protects the portion 28 of the post 14 that is snugly received within the post-receiving area 34. Upon installation as described above, it is believed that the anchoring foot 24 of the present invention should require little, if any, maintenance and may provide a long service life. Furthermore, the body 26 of the anchoring foot 24 is formed of a suitable material designed to withstand the outdoor elements and includes a liquid drain area 82 that communicates with drain openings 84, 86 to allow water or other liquid to drain away from the post 14, as described above, to protect the same and extend the useful life of the post 14.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventors hereby state their intent to rely on the Doctrine of Equivalents to determine and access the reasonably fair scope of the present invention as pertains to any apparatus not materially departing from but outside the literal scope of the invention set forth in the following claims.

What is claimed is:

1. A post anchoring foot for use in securing a post to a surface, said foot comprising:

a body dimensioned to snugly receive a portion of the post, said body including a generally horizontally extending base portion and a generally upstanding side wall configured to circumscribe the received portion of the post, said base portion and said side wall cooperatively presenting a substantially laterally enclosed post-receiving area, said base portion defining a lowermost surface-engaging anchoring face, said base portion defining an elevated supporting face configured to engage an end of the received portion of the post, said supporting face being disposed above said anchoring face, said base portion defining a plurality of anchor-receiving apertures extending therethrough, each aperture being configured to selectively receive an anchor therein to securely couple the foot to the surface, said side wall presenting a laterally inner post-engaging face and an opposite laterally outer face, said side wall defining a fastener-receiving hole extending therethrough between the inner and outer faces, with the hole being disposed above the supporting face, said hole being configured to selectively receive a fastener therein to securely couple the foot to the post, said anchoring face comprising a plurality of discrete surface-engaging stand elements such that the anchoring face is discontinuous about a laterally outer periphery of the base portion, said side wall comprising a plurality of side wall portions, each side wall portion corresponding to a side of the portion of the post to be received in the post-receiving area, said base portion presenting a substantially polygonal laterally outer periphery, one of said plurality of discrete surface-engaging stand elements being disposed adjacent a corner of the laterally outer periphery of the base portion, said body including a liquid drain area defined between the anchoring face and the support face, said outer face of each side wall portion defining a plurality of drain openings therein, with each drain opening extending upwardly from the anchoring face such that the liquid drain area is in fluid communication with the environment via the drain opening, said supporting face intersecting a plurality of drain holes defined by the base portion of the body and extending therethrough, with each drain hole being disposed adjacent a corner of the laterally outer periphery of the supporting face such that the post-receiving area is in fluid communication with the liquid drain area, each of said corner-disposed surface-engaging stand elements defining a substantially hollow space in fluid communication with a respective one of the corner-disposed drain holes such that each drain hole is in fluid communication with the environment via a drain opening.

2. The post anchoring foot as claimed in claim 1, said supporting face being defined by a substantially planar bottom floor.

3. The post anchoring foot as claimed in claim 2, said bottom floor extending generally horizontally such that the bottom floor and the side wall are substantially orthogonal to one another.

4. The post anchoring foot as claimed in claim 1, said anchor-receiving apertures comprising laterally extending slots.

5. The post anchoring foot as claimed in claim 4, each of said slots including a recessed anchor-engaging surface disposed below the supporting face such that an anchor received within the slot does not extend above the supporting face.

6. The post anchoring foot as claimed in claim 1, said side wall including a countersink around the fastener-receiving hole, said countersink extending inwardly from the outer face of the side wall.

7. The post anchoring foot as claimed in claim 1, said supporting face presenting a substantially polygonal laterally outer periphery.

8. The post anchoring foot as claimed in claim 7, said inner face of each side wall portion presenting a horizontal dimension that is approximately equal to the horizontal dimension of the inner face of each other side wall portion, said supporting face presenting a substantially regular polygonal outer periphery.

9. The post anchoring foot as claimed in claim 8, adjacent pairs of the side wall portions intersecting one another at right angles such that the inner faces of the side walls cooperatively form a square-shaped laterally outer periphery of the post-receiving area.

10. The post anchoring foot as claimed in claim 9, said horizontal dimension of the inner face of each side wall portion measuring approximately 5.5 inches such that the post-receiving area is configured to snugly receive a 6 inch by 6 inch post therein.

11. The post anchoring foot as claimed in claim 1, said supporting face being defined by a substantially planar bottom floor, said bottom floor intersecting at least one drain hole defined by the base portion of the body and extending therethrough such that the post-receiving area is in fluid communication with the liquid drain area.

12. The post anchoring foot as claimed in claim 11, said bottom floor presenting a substantially polygonal laterally outer periphery.

13. The post anchoring foot as claimed in claim 12, said bottom floor intersecting a plurality of drain holes defined by the base portion of the body and extending therethrough, with each drain hole being disposed adjacent a corner of the laterally outer periphery of the bottom floor, with at least one of each of the drain openings being in fluid communication with each drain hole.

14. The post anchoring foot as claimed in claim 1, said body being formed of a synthetic resin material.

15. The post anchoring foot as claimed in claim 14, said body consisting essentially of a unitarily-formed molded element.

16. The post anchoring foot as claimed in claim 15, said unitarily-formed molded element being formed of high-density polyethylene.

* * * * *